United States Patent [19]

Chavarria

[11] 4,134,575

[45] Jan. 16, 1979

[54] SPREADER FOR THE WIRES OF A MULTI-STRAND WIRE FENCE

[76] Inventor: Antonio M. Chavarria, Aristobulo del Valle, 1302 San Isidro-Martinez-Buenos Aires, Argentina

[21] Appl. No.: 804,293

[22] Filed: Jun. 7, 1977

[30] Foreign Application Priority Data

Mar. 25, 1977 [AR] Argentina ..... 266978

[51] Int. Cl.[2] ..... E04H 17/14

[52] U.S. Cl. ..... 256/35; 256/57; 256/52

[58] Field of Search ..... 256/48, 57, 58, 35, 256/52, 36

[56] References Cited

U.S. PATENT DOCUMENTS

| | | | |
|---|---|---|---|
| 284,806 | 9/1883 | Brooks | 256/58 |
| 312,524 | 2/1885 | Smolley | 256/58 |
| 536,955 | 4/1895 | Jones et al. | 256/36 |
| 540,161 | 5/1895 | Gross | 256/36 |
| 569,019 | 10/1896 | Greene | 256/36 |
| 598,226 | 2/1898 | Hopler | 256/57 |
| 622,345 | 4/1899 | Greig et al. | 256/48 |
| 660,595 | 10/1900 | Sheets | 256/57 |
| 1,065,471 | 6/1913 | Rohe | 256/48 |
| 1,179,862 | 4/1916 | Parrish | 256/48 |
| 2,471,682 | 5/1949 | Grob | 256/48 |
| 3,606,259 | 9/1971 | Farrell | 256/48 |

*Primary Examiner*—Andrew V. Kundrat
*Attorney, Agent, or Firm*—McGlew and Tuttle

[57] ABSTRACT

The spreader, designed for use with a multi-strand wire fence including a top wire, a bottom wire and intermediate wires, comprises an elongated substantially rectilinear and relatively narrow flat metal plate formed with respective notches opening outwardly through its opposite ends to receive the top and bottom wires, and with respective apertures adjacent the closed inner end of each notch, for receiving fastening wires securing the plate to the top and bottom wires and maintaining the plate with its planar faces substantially perpendicular to the wires of the fence. Intermediate its ends, the plate is formed with a plurality of longitudinally spaced notches opening outwardly through a side edge thereof and into which the intermediate wires of the fence may be engaged after the plate is secured to the top and bottom wires. Preferably respective apertures are provided adjacent the inner ends of the notches opening through the side edge of the plate to receive fastening wires for securing the plate firmly to the intermediate wires of the fence. The notches in the side edge of the plate may have an inverted L-shape providing a tongue which may be bent in by pincers or the like to retain the intermediate wire in the notch. Alternatively, the notches in the side edge of the plate may be rectilinear and extend inwardly at an angle to the side edge, may be an inverted J-shape, or may extend perpendicular to the side edge of the plate.

6 Claims, 6 Drawing Figures

SPREADER FOR THE WIRES OF A MULTI-STRAND WIRE FENCE

FIELD AND BACKGROUND OF THE INVENTION

This invention relates to spreaders for the wires of a multi-strand wire fence including a top wire, a bottom wire and intermediate wires, and, more particularly, to a novel and improved such spreader adapted to be easily engaged with the top and bottom wires of the fence and secured thereto with an orientiation resisting twisting of the spreader and formed to have the intermediate wires of the fence readily and easily engaged therein and secured thereto.

Spreaders to be mounted directly without threading wire by wire are known, such as those shaped as a plate with longitudinal grooves or slots in the borders for receiving the fence wires, as well as those shaped as cylindrical bars with hooks and means for hooking in their ends. All of these have disadvantages with respect to practical acceptance, because they are easily twisted or deviated from the vertical after placing. Furthermore, these solutions have further disadvantages, because it is necessary to support the wires during their fastening, to avoid their fall or their vertical displacement by their own weight, all of which constitute a complication for the installment job.

SUMMARY OF THE INVENTION

The main object of the present invention is to provide a spreader for a multi-strand wire fence, and which is shaped as an elongated substantially rectangular and relatively narrow flat plate, preferably of steel and having substantially elongated notches therein opening through at least one side edge. Preferably, apertures are formed adjacent the closed ends of the notches to receive fastening wires for securing the intermediate wires of the fence firmly to the spreader. At least one end of the plate is formed with a groove opening outwardly therethrough, substantially centrally of the plate, to receive either the top or bottom wire of the fence, and each of these end notches has, adjacent its closed inner end, an aperture for receiving a fastening wire for securing the plate to the top and bottom wires with the plate firmly anchored to be oriented perpendicular to the length of the fence. Such apertures may also be provided adjacent the closed inner ends of the notches opening through the side edge of the plate, also for receiving fastening wires for securing the plate firmly to the intermediate wires.

More specifically, the present invention is directed to a spreader for multi-strand wire fences that, in contrast to known spreaders, has the advantage of being capable of installation without loosening the wires of the fence in order to engage the wires in the notches of the spreader. A further substantial improvement over known devices is that the spreader, when once installed, maintains its orientation perpendicular to the length of the wire fence, to which it is securely connected by the fastening wires or bindings. Thus, later deviations and twistings of the spreader, usually caused by animals contacting the wire fence, for scraping or simply for resting, are avoided.

With the spreader of the present invention, all above the mentioned, disadvantages of known spreaders are overcome, and superior results are obtained after installation, since the spreaders are secured to the fence wires without the possibility to be tilted or twisted, being orientated perpendicularly to the plane of wire fence, and being able so to withstand better the lateral stresses resulting from animals contacting the fence. The spreaders can't be displaced with regard to the wires, they are capable of rapid and easy installment and, besides many other advantages that shall be understood through the disclosure, they are very economical.

Such advantages result directly from the newly combined features in the spreader embodying the invention, that, as above said stated is shaped as an elongated, substantially rectilinear and relatively narrow flat plate, preferably of steel, having longitudinally spaced side-grooves or notches, and having at least one end edge formed with a relatively elongated notch opening outwardly therethrough and extending substantially centrally of the plate, such a notch being preferably formed in both end edges of the plate. Adjacent the closed inner end of each end notch, the plate is formed with an aperture for receiving a small diameter wire serving as a fastening wire to secure the plate to the top and bottom wires of the fence. The purposes of such fastening wires are to support the plate while the intermediate wires are engaged in the notches opening through the side edge of the plate, and for avoiding subsequent displacements or twistings with respect to the vertical axis of the plate.

For installing each spreader of this type, the spreader is placed so that its end notch engages the bottom wire, (if there is only one groove) or one notch engages the bottom wire and the other the top wire. Then, the respective fastenings are made, at the top and bottom wires of the fence. Later, the intermediate wires are engage in the elongated side-notches, and the side notches are closed by nippers or pincers, to prevent disengagement of the wires from the notches optionally, fastenings similar to those mentioned above can be added for all the intermediate wires, whereby the fastening is even more secured, especially against twistings and partial deviations of the rod. Besides that, a perfect maintenance is obtained with regard to the edge position of the rod with respect of the wire fence plane.

For an understanding of the principles of the invention, reference is made to the following description of typical embodiments thereof as illustrated in the accompanying drawings.

DESCRIPTION OF THE PREFERRED EMBODIMENTS

Figure 1:
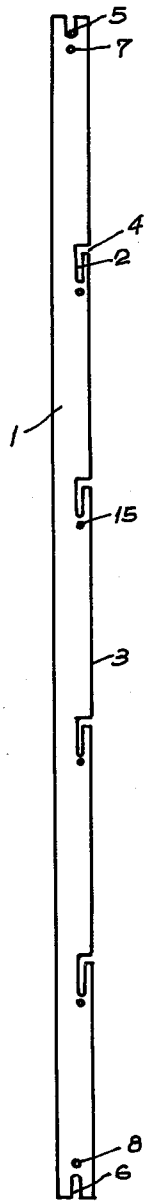
FIG. 1 shows a frontal view of a spreader for a wire fence, according to the present invention.

In each figure, the numbers correspond to the same parts or constitutive element of the whole, according to the illustrated example for the explanation of the wire fencing spreader.

As can be seen in the figures, the spreader of this invention is formed by an elongated, substantially rectangular and relatively narrow flat metal plate 1, preferably of steel, having parallel planar faces bordered by side edges 3 and end edges. One side edge 3 has a plurality of longitudinally spaced, substantially elongated notches 2 formed therein and opening therethrough as at 4, the major length of the L-shaped notches 2 extending substantially parallel to the side edge 3. The openings 4 of the notches 2 provide for insertion, into the notches 2, the intermediate wires 14 of a multi-strand wire fence including a top wire 11 and a bottom wire 12, the intermediate wires being inserted into the notches 2 without loosening of these wires.

Figure 2:
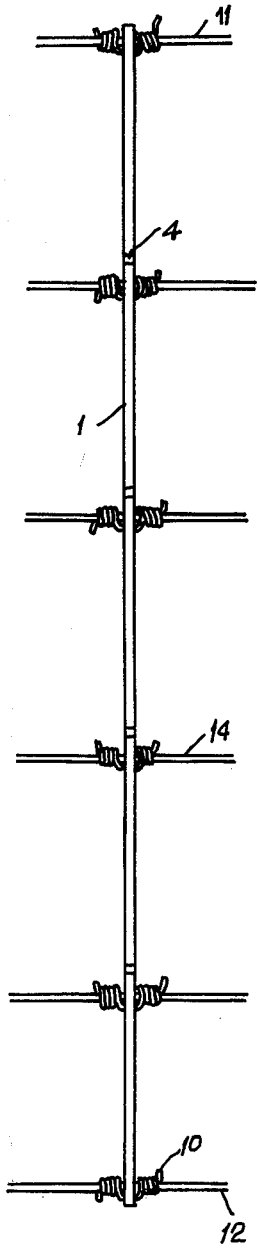
FIG. 2 shows a side view of the same spreader, including partial portions of the wire fence where it is placed.
Figure 3:
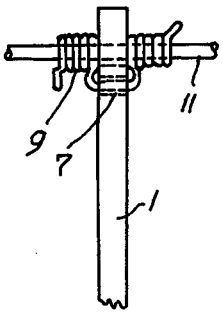
FIG. 3 shows an enlarged detail of the top fastening of the spreader, as shown in FIGS. 1 and 2.

An important feature of the present invention resides in the provision of the notches 5 and 6 opening through at least one end of the plate 1, these notches being relatively deep and extending substantially centrally of the plate 1. Notches 5 and 6 have closed inner ends adjacent which plate 1 is formed with respective apertures 7 and 8 receiving fastening wires 9 and 10, shown in FIGS. 2 and 3.

Such fastening wires are of small section, able to be twisted as shown in the figures, according to the rural practice.

The fastenings are twisted around the top and bottom wires 11 and 12 of the fence, so as to avoid relative displacement of one or both ends of the plate 1 with regard to these wires. The holes or apertures 7 and 8 according to this invention are at a minimal distance from the inner ends of the notches 5 or 6, and preferably have a diameter only slightly larger than that of the fastening wire.

Another novel aspect of this invention is the addition of similar holes for fastening wires, adjacent the closed inner ends of the longitudinal notches 2 for the intermediate wiring, through which holes the same fastenings can be made, as explained. In such condition, the spreader will be totally fastened, with its side edges 3 opposed to the vertical plane of the wires of the fence, i.e., with its main planar surfaces perpendicular to such plane, so that its flexural strength be the highest.

Figure 4:
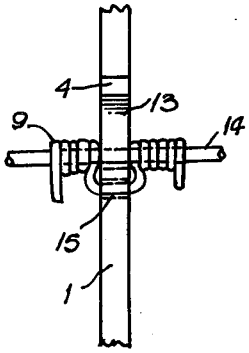
FIG. 4 shows and enlarged detail of an intermediate fastening.
Figure 5:
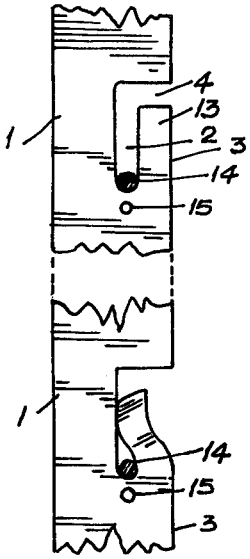
FIG. 5 shows and enlarged detail of a notch opening through the edge, before and after the placing of the respective intermediate wire therein spreader side.

FIG. 5 illustrates the insertion and anchoring of intermediate wires 14 inserted through the openings 4 into the notches 2. The formation of the inverted L-shaped notches 2 results in the formation of the languet or tongue 13 between each notch 2 and the adjacent side edge 3 of the plate 1. After intermediate wire 14 has been inserted into a slot 2, as shown in the upper portion of FIG. 5, the languet or tongue 13 is bent inwardly, by nippers or the like, to closely grip the intermediate wire 14 and retain it securely in the notch 2. Preferably, apertures 15, having a diameter only slightly larger than that of a fastening wire, are formed in plate 1 directly below the closed lower end of each notch 2. These apertures 15 receive fastening wires 9, such as shown in FIG. 4, which are twisted around the intermediate wires 14 and reinforce the securement of the intermediate wires 14 in the notches 2.

Figure 6:
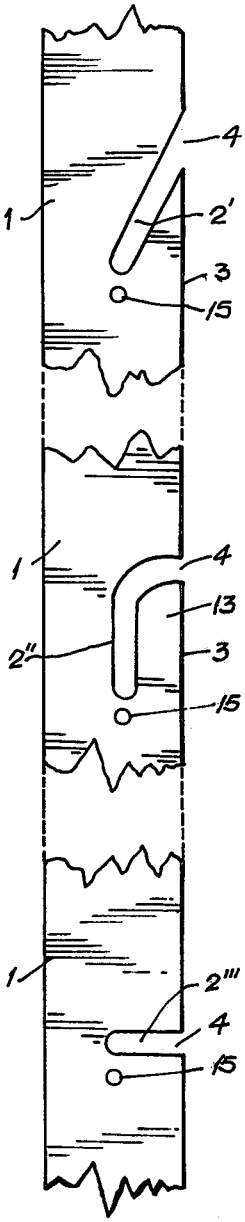
FIG. 6 shows some variations of the slots opening through the spreader edge.

FIG. 6 illustrates variations of the slots for receiving the intermediate wires 14. Thus, the slot 2 may be formed as a slot 2' which extends at an angle to the side edge 3 of the plate 1, or may be formed as an inverted J-shaped slot 2''. Alternatively, the slot 2 may be formed as a slot 2''' extending perpendicular to the side edge 3 of the spreader plate 1. In each case, an aperture 15 is provided adjacent to the closed end of a slot for receiving a fastening wire 9 such as shown in FIG. 4.

While specific embodiments of the invention have been shown and described in detail to illustrate the application of the principles of the invention, it should be understood that the invention may be embodied otherwise without departing from such principles.

I claim:

1. A spreader for the wires of a multi-strand wire fence including a top wire, a bottom wire and intermediate wires, said spreader comprising an elongated, substantially rectangular and relatively narrow flat planar metal plate having parallel planar faces bordered by side edges and end edges; said plate being formed with respective notches opening outwardly through each end thereof, for receiving such top and bottom wires, and with an aperture adjacent the closed inner end of each notch with said notches and apertures being aligned along the major axes of said plate, for receiving a fastening wire securing said plate to the wire received in the respective notch and maintaining said plate with its planar faces substantially perpendicular to the wires of said fence; whereby said spreader may be engaged with such top and bottom wires of the multi-strand wire fence and be supported solely by such top and bottom wires while it is being connected to such intermediate wires, leaving the operator's both hands free to effect fastening of the wires in position; said plate being formed with plural, longitudinally spaced notches opening outwardly through at least one side edge thereof for receiving the intermediate wires of said fence, while said plate is supported solely by such top and bottom wires, and retaining the intermediate wires in spaced relation to each other and to such top and bottom wires.

2. A spreader, as claimed in claim 1, in which said plate is formed with respective apertures adjacent the closed inner ends of said notches opening outwardly through said at least one side edge, for receiving fastening wires securing said plate to the respective intermediate wires of said fence.

3. A spreader, as claimed in claim 1, in which said notches opening outwardly through said at least one side edge of said plate have an inverted L-shape with the longer leg extending parallel to said at least one side edge.

4. A spreader, as claimed in claim 1, in which said notches opening outwardly through said at least one side edge of said plate extend inwardly at an acute angle to said at least one side edge.

5. A spreader, as claimed in claim 1, in which said notches opening outwardly through said at least one side edge of said plate have an inverted J-shape with the stem of the J extending substantially parallel to said at least one side edge.

6. A spreader, as claimed in claim 1, in which said notches opening outwardly through said at least one side edge of said plate extends inwardly perpendicular to said at least one side edge.

* * * * *